US005400934A

United States Patent [19]

Ducros

[11] Patent Number: 5,400,934

[45] Date of Patent: Mar. 28, 1995

[54] RUCKSACK

[75] Inventor: Pascal Ducros, Passy, France

[73] Assignee: Skis Rossignol S.A., Voiron, France

[21] Appl. No.: 132,305

[22] Filed: Oct. 6, 1993

[30] Foreign Application Priority Data

Oct. 16, 1992 [FR] France ..... 92 12672

[51] Int. Cl.[6] ..... A45F 3/04

[52] U.S. Cl. ..... 224/148; 224/209; 128/205.22; 128/202.15

[58] Field of Search ..... 224/148, 902, 250, 209, 224/215; 128/200.28, 200.29, 205.22, 206.27, 202.18, 207.17, 206.17, 202.15

[56] References Cited

U.S. PATENT DOCUMENTS

| | | | |
|---|---|---|---|
| 2,406,888 | 9/1946 | Meidenbauer, Jr. | 128/205.22 |
| 2,676,738 | 4/1954 | Herrick | 224/902 |
| 2,723,665 | 11/1955 | Goldsmith | 224/148 |
| 3,718,241 | 2/1973 | Forsythe | 224/250 |
| 4,062,356 | 12/1977 | Merrifield | 224/148 |
| 4,197,890 | 4/1980 | Simko | 224/148 |
| 4,398,533 | 8/1983 | Barker | 128/202.15 |
| 4,420,097 | 12/1983 | Motsenbocker | 224/148 |
| 4,438,764 | 3/1984 | Eppolito | 128/205.22 |
| 4,574,798 | 3/1986 | Heitzman | 128/205.22 |
| 4,739,913 | 4/1988 | Moore | 128/205.22 |
| 4,921,143 | 5/1990 | Billet | 224/148 |
| 4,948,023 | 8/1990 | Tripp | 224/148 |
| 5,060,833 | 10/1991 | Edison et al. | 224/148 |
| 5,104,016 | 4/1992 | Runkel | 224/148 |
| 5,143,266 | 9/1992 | Heckerman | 224/150 |
| 5,207,719 | 5/1993 | Janus | 224/148 |
| 5,282,557 | 2/1994 | McCook | 224/209 |

*Primary Examiner*—Henry J. Recla
*Assistant Examiner*—Gregory M. Vidovich
*Attorney, Agent, or Firm*—Browdy and Neimark

[57] ABSTRACT

A rucksack, or backpack, making it possible to drink, or inhale oxygen, whilst walking. The rucksack comprises two straps wherein at least one of its two straps defines a protective, isothermic inner space, for example by means of a foldable protective band which is sewn on the upper half of the strip. A recipient is placed in the rucksack and its tube passes in this protective space and finally terminates in a valve for drinking or inhaling.

12 Claims, 6 Drawing Sheets

Fig. 5
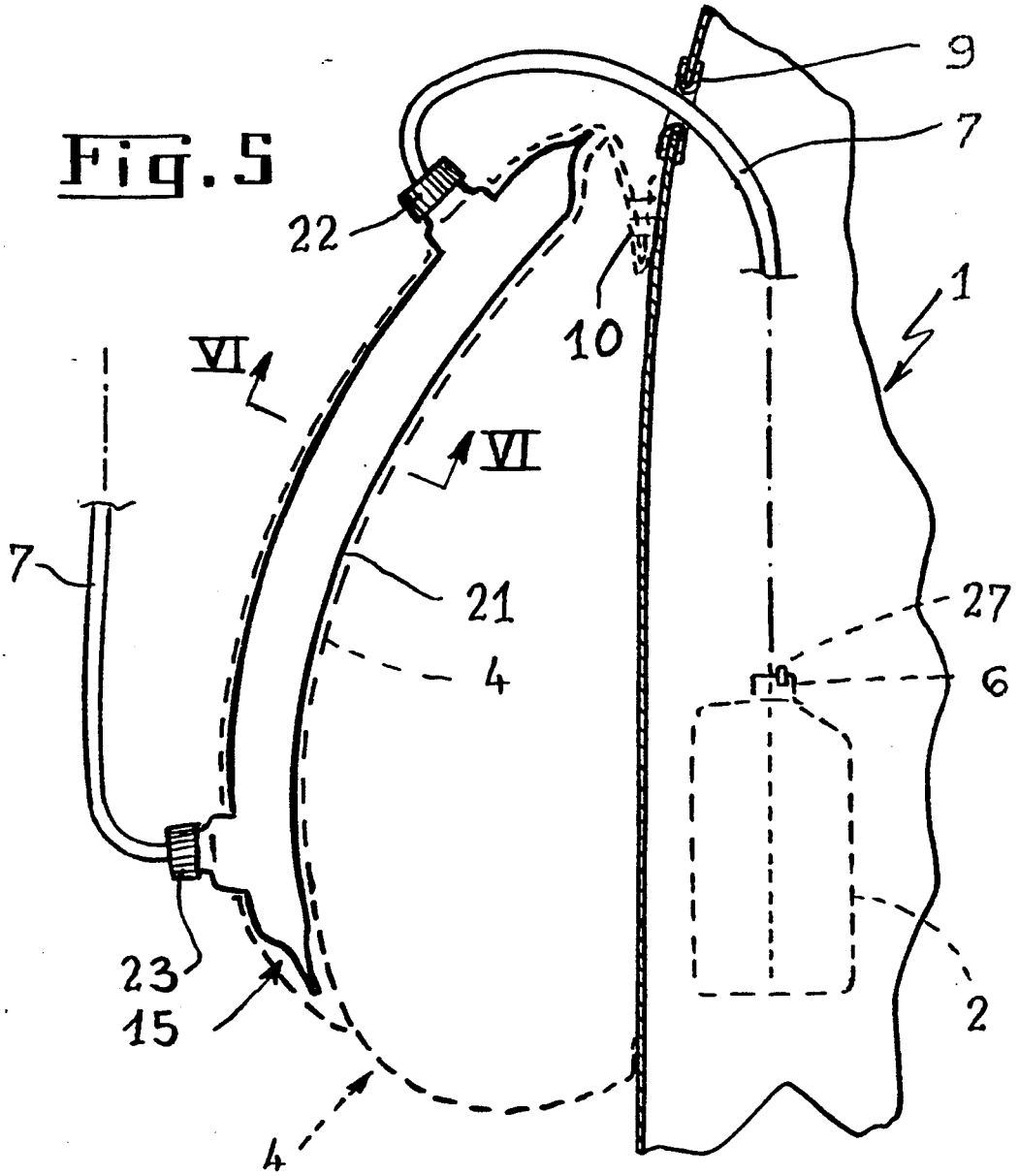
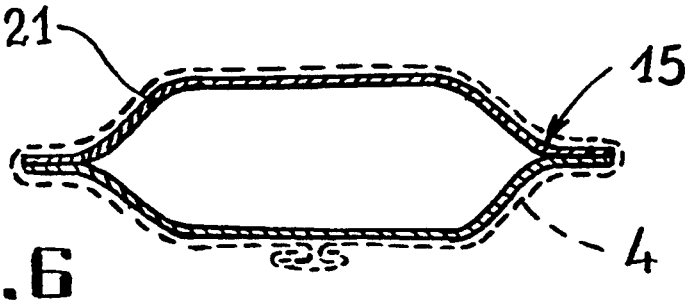
Fig. 6

RUCKSACK

FIELD OF THE INVENTION

The present invention relates to a rucksack, or backpack, and in particular to a rucksack provided for use under harsh climatic conditions, for example at high altitude.

BACKGROUND OF THE INVENTION

To quench one's thirst when mountaineering, it is usual to provide a flask of water, or other liquid, carried in a rucksack. In that case, it is necessary to stop, place the bag on the ground, take the flask from the bag in order to drink, then replace this flask in the bag and finally put the rucksack back on one's back before setting off again.

This sequence is long and tedious and in any case obliges the hiker to stop, which he/she does not necessarily desire.

To solve this difficulty, it is possible to have a flask, such as one presently available on the market, provided to be attached to one's belt and fitted with a pipette composed of a connection screwed on the flask and extended by a long tube terminating in a valve. It is thus possible to quench one's thirst whilst walking.

However, this solution is uncomfortable since the hiker is already carrying his/her rucksack and, in high mountains, the liquid risks freezing in the tube fixed on the flask.

More generally, it must be admitted that, with this known device, said tube is not protected from outside agressions such as accidental shocks or the risks of hooking on branches of trees or rocks. Finally, if the hiker is walking in the heat, the water contained in the tube is hot or warm and therefore virtually undrinkable.

It is an object of the invention to overcome these drawbacks.

SUMMARY OF THE INVENTION

To that end, the present invention relates to a rucksack, or backpack, which is conventionally provided with two straps serving to carry it on the shoulders. At least one of these straps presents, over at least part of its length, an inner space which allows protected passage of a fluid in the form of a conduit for passage of this fluid, possibly via an auxiliary. The pipe can be composed of a flexible tube housed in the inner space in the strap permits the fluid to be conveyed to the consumer, and more precisely to his/her mouth, if it is a liquid to be drunk. If it is a gas to be inhaled, a valve or a mask consequently is provided at the free end of this flexible tube.

BRIEF DESCRIPTION OF THE DRAWINGS

The invention will be more readily understood on reading the following description with reference to the accompanying drawings, in which:

FIG. 5 very schematically illustrates another embodiment of this rucksack.

FIG. 6 is a view in section, along VI—VI of FIG. 5, of the strap of the latter rucksack.

DETAILED DESCRIPTION OF THE DRAWINGS

Figure 1:
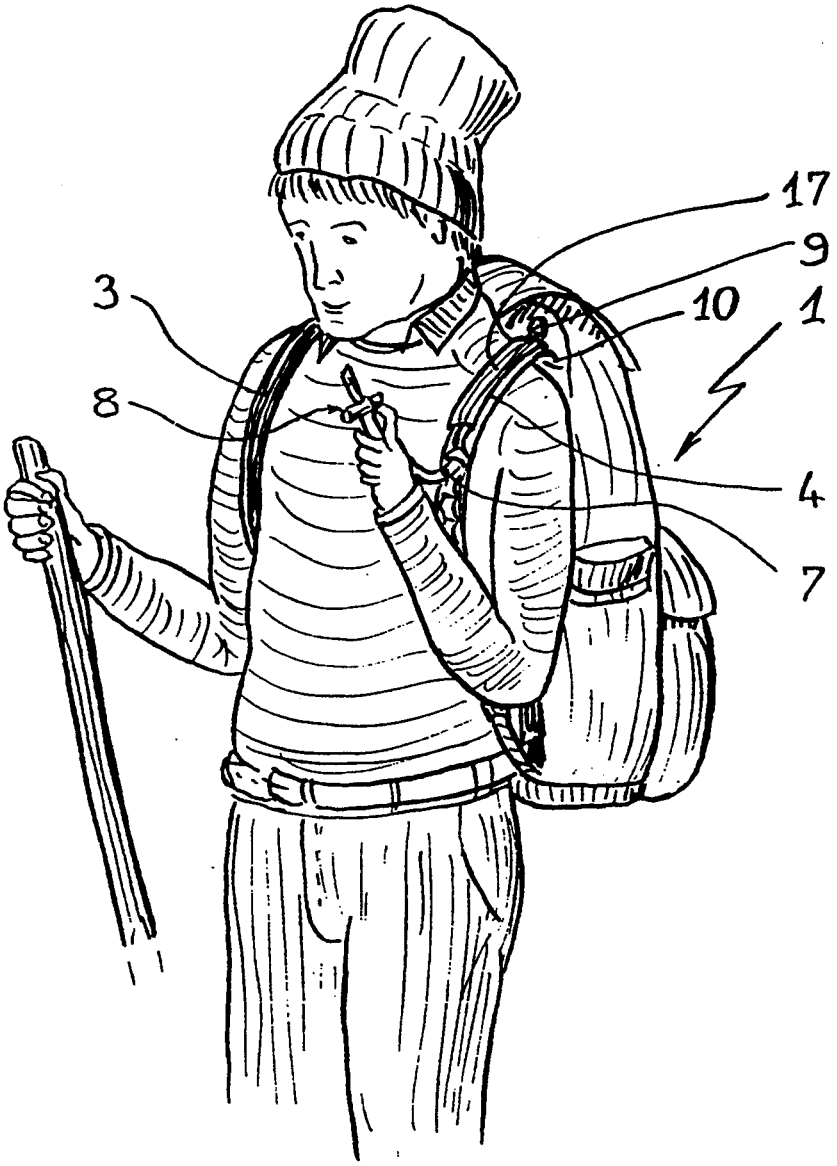
FIGS. 1 and 2 show a first embodiment of the rucksack according to the invention, shown respectively when used by a hiker (FIG. 1) and alone with parts torn away (FIG. 2).
Figure 2:
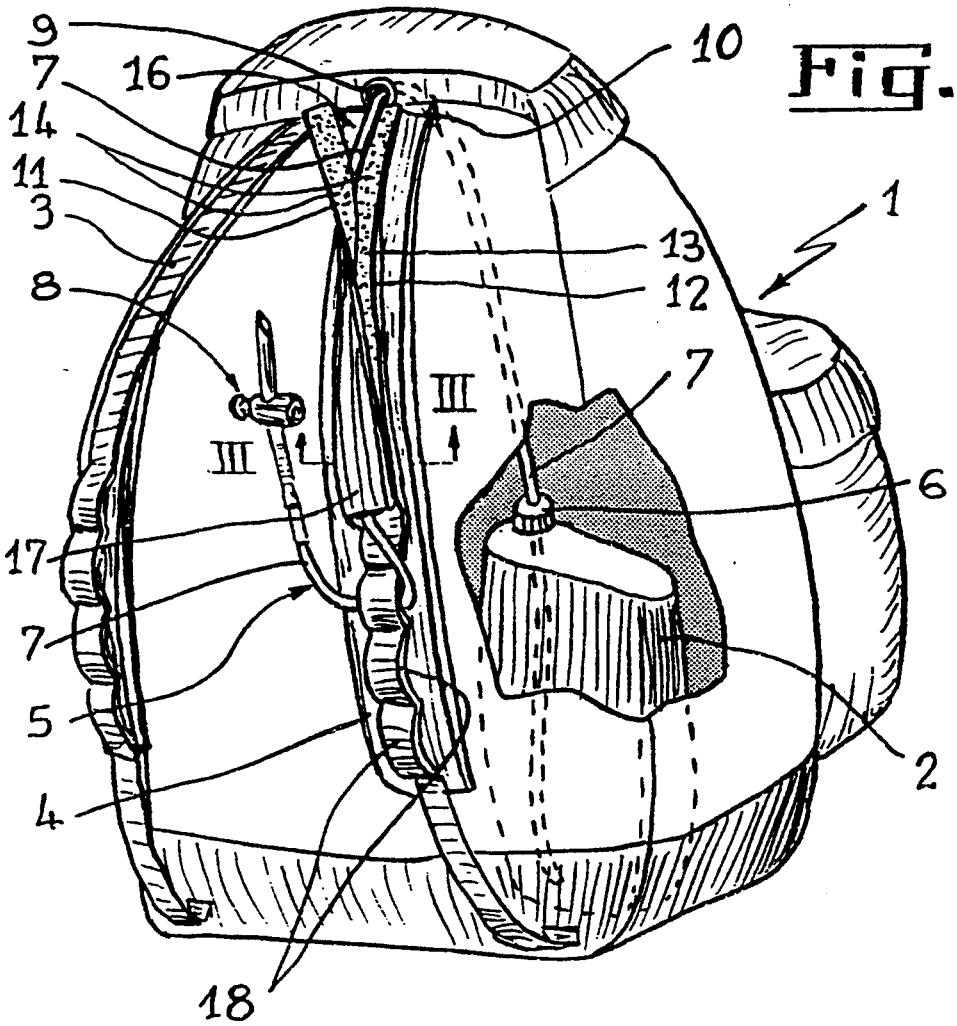
Figure 3:
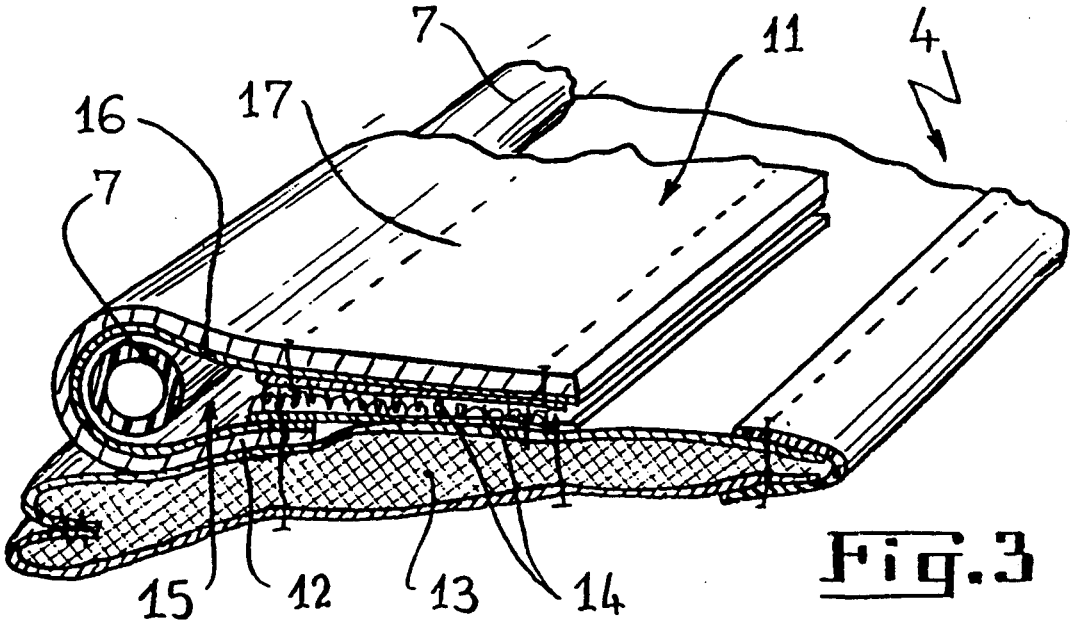
FIG. 3 is a view in detail of the left-hand strap of this rucksack, along III—III of FIG. 2.

Referring now to the drawings, FIGS. 1 to 3 show a rucksack 1 provided with two straps 3, 4 passing over the user's shoulders (FIG. 1).

In order to be able to quench one's thirst whilst walking, a flask 2 is placed inside this rucksack 1, among the other articles contained therein, but preferably well surrounded for optimum insulation.

In manner known per se, a pipette 5 is fitted on this flask 2, said pipette being composed of a connection 6 which is screwed in place of the normal stopper of the flask 2 and which is extended by a relatively long flexible plastic tube 7, itself terminating in a valve 8, for example of the type closed by a pusher. The connection 6 is provided with a non-return valve 27 which makes it possible to extract the beverage contained in the flask 2 by suction, via the tube 7, whilst eliminating the depression created by such suction.

An eyelet 9 is provided in the upper part of the rucksack to allow passage for this pipe 7 towards the outside. This eyelet 9 is located just above the upper fastening 10 of the left-hand strap 4.

According to the invention, and in order to protect and insulate the major part of the tube 7 located outside the rucksack 1, the strap 4 is provided, here on its upper half, with an added band 17 which is double the width normally necessary, and of which the right-hand half 11 is free and is folded as shown on its left-hand half 12, itself sewn on the "normal" part 13 of the strap 4, partially sticking against this left-hand half by means of complementary rapid fastening means, of the so-called velvet or touch-and-close type, so as thus to define, for this strap 4, a protective inner space 15 in which the plastic tube 7 passes.

A heat-insulating coating 16, for example of reflecting type, is advantageously sewn inside the added band 17, this protecting the tube 7 and its liquid contents either against the cold or against the heat.

The tube 7 then emerges at the bottom of the folded protective band 17 where it is then passed through one of the loops 18 provided on the strap 4, at the convenient height (which is therefore adjustable by selecting the loop 18) for the consumer's mouth, as shown schematically in FIG. 1.

Figure 4:
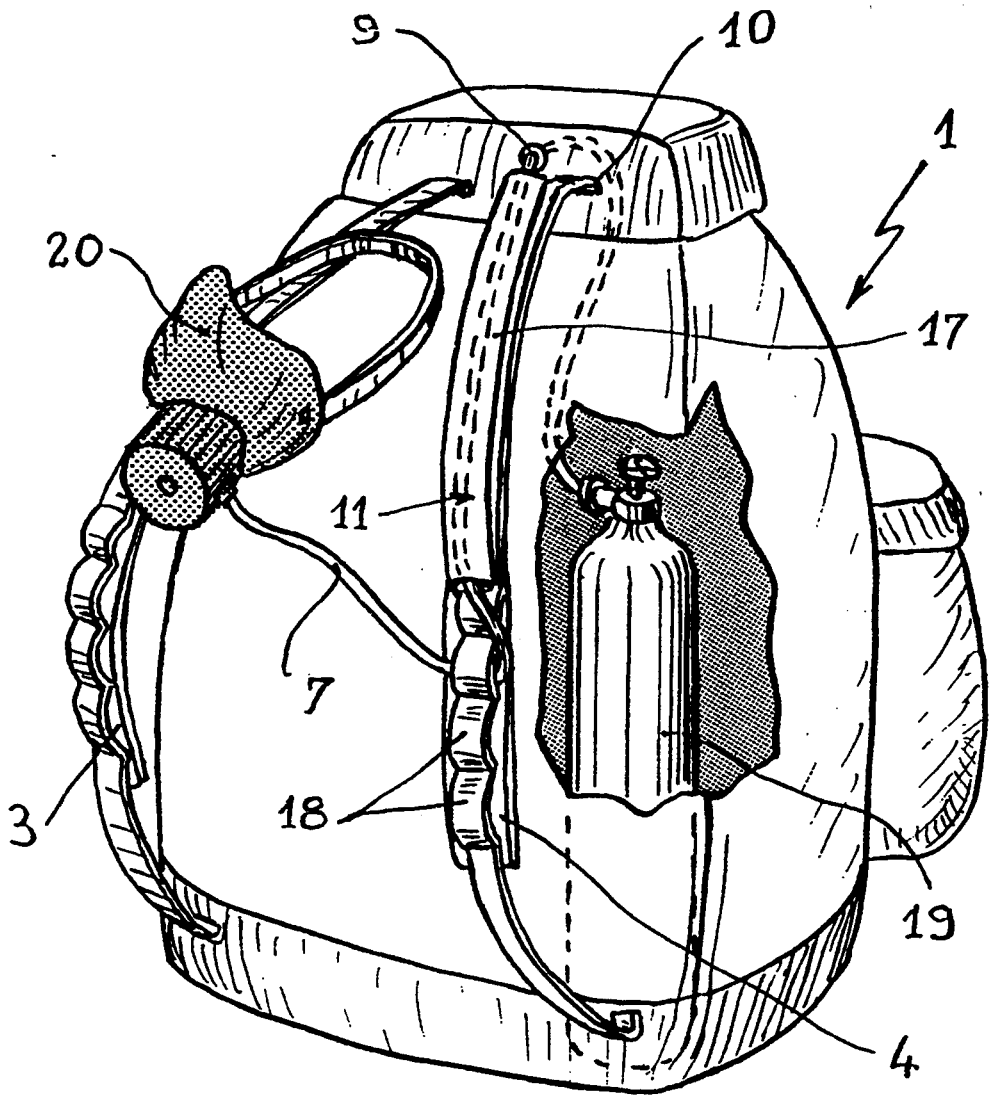
FIG. 4 shows a variant use of the rucksack of FIG. 3.

FIG. 4 shows a use of this same rucksack, more especially intended for very high altitudes where the air is rarefied and for which, on the one hand, the flask 2 is replaced by an oxygen cylinder 19 and, on the other hand, the pipette 8 for drink is replaced by an oxygen mask 20.

According to the embodiment of FIGS. 5 and 6, the hollow inner space 15 in the strap 4 itself contains a tight bag 21 which presents substantially the same long, flat form as this inner space 15 and which itself serves as pipe for transfer of the liquid from the flask 2. Two connections 22 and 23 are then provided for the upstream and downstream parts of the flexible tube 7.

Figure 7:
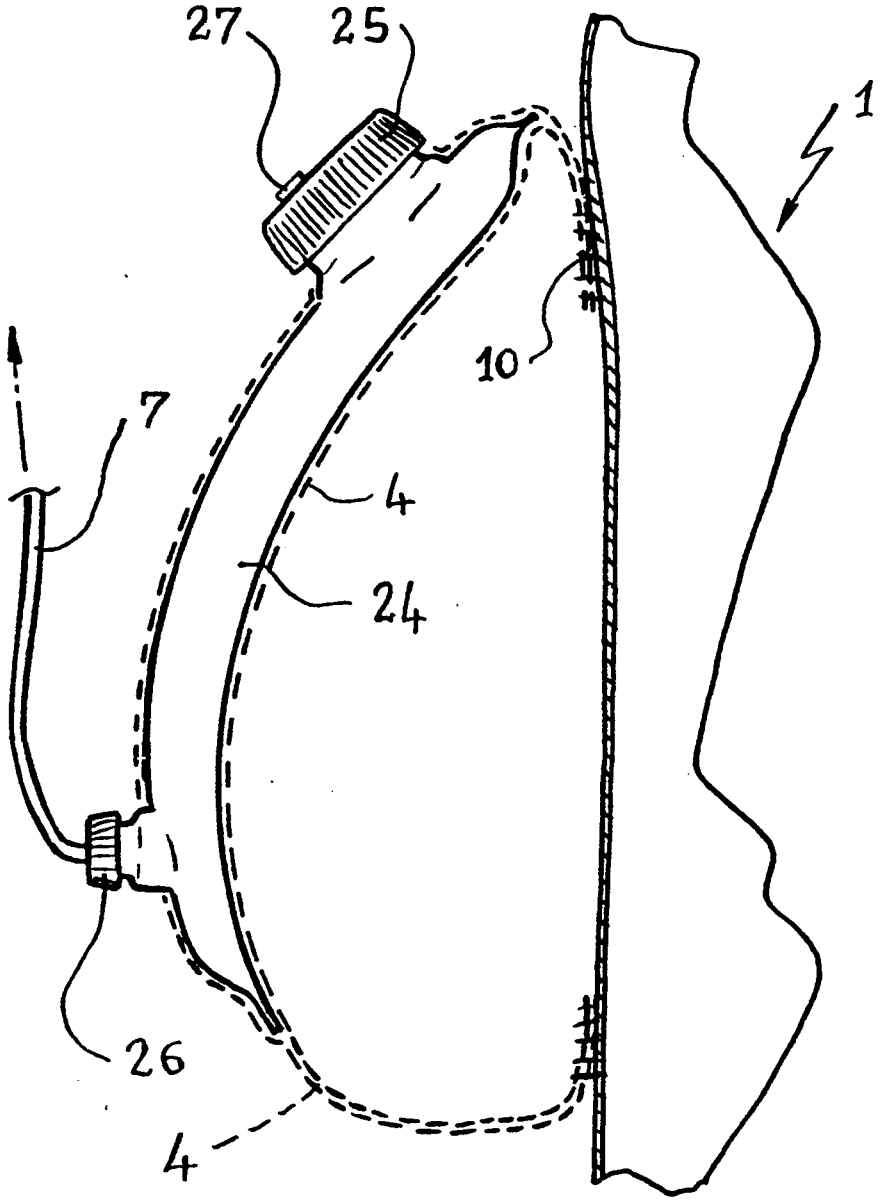
FIG. 7 is a view similar to FIG. 5, showing another embodiment of this rucksack.

According to the embodiment of FIG. 7, it is the strap 4 itself which serves as a flask and which therefore contains the liquid or other fluid. The inner space 15 in that case contains a tight bag 24, which forms a flask and which has substantially the same long, flattened shape as this inner space. A stopper 25 for filling is consequently provided in the upper part of this bag 24, i.e. in the upper part of the strap 4, whilst a connection 26 for connection of the flexible tube 7 is provided in the lower part of this same bag 24.

Figure 8:
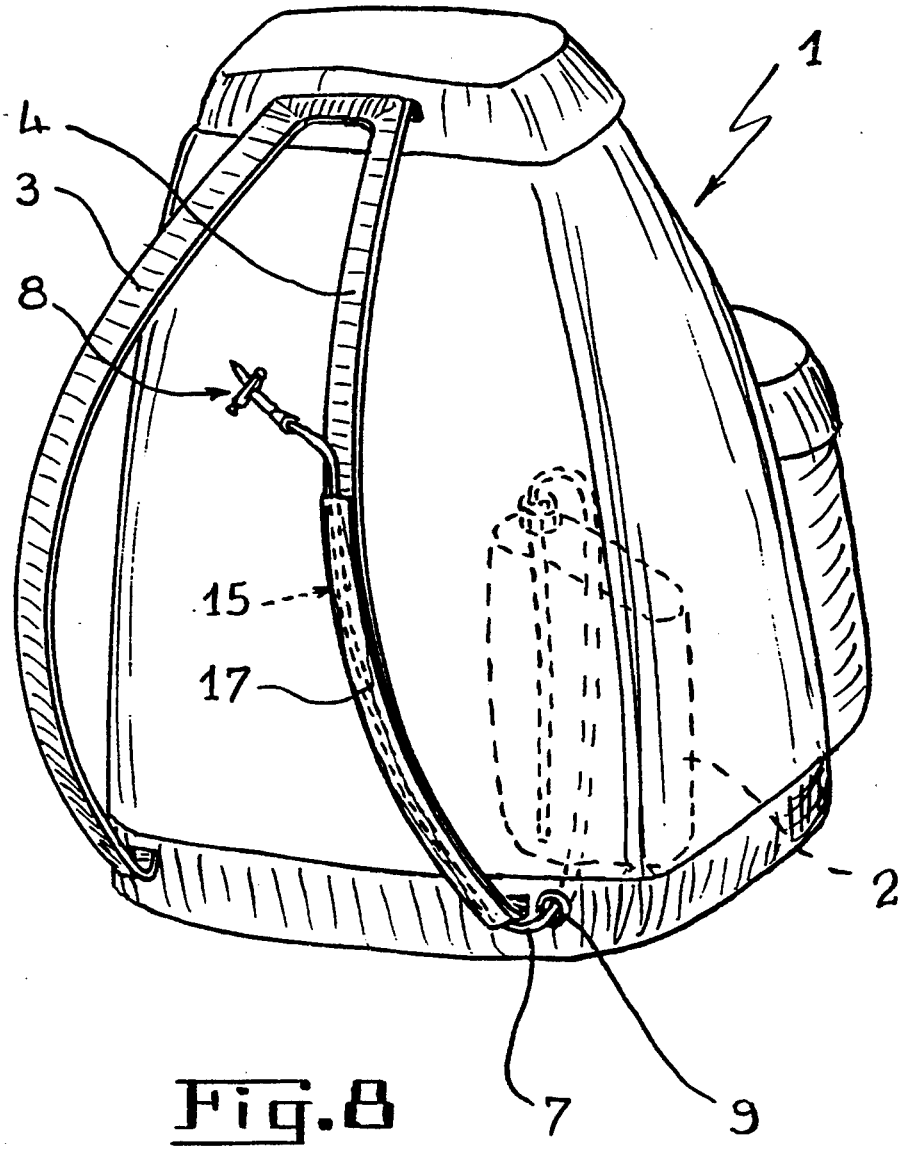
FIG. 8 is a view similar to FIG. 2, showing another variant embodiment.

Finally, FIG. 8 shows a variant embodiment of the rucksack of FIG. 1, for which the folded protective band 17 which forms the protective inner space of the strap 4 is placed on the lower half of this strap instead of on its upper half. The eyelet 9 for passage of the tube 7 is then placed at the bottom of the strap 4 and not at the top, with the result that the tube 7 rises, in the inner protective space 15, towards the valve 8 for drinking.

It goes without saying what the invention is not limited to the embodiments which have just been described. For example, each strap 3, 4 of the rucksack 1, instead of only strap 4, may be shaped to present said hollow protective space: in that case, a different liquid may be made to pass in each strap.

What is claimed is:

1. A rucksack for transporting articles under harsh climatic conditions, comprising:

two straps having first and second ends adapted to be connected to said rucksack for carrying said rucksack on the shoulders of a user, wherein at least one of said two straps has over at least part of a length thereof immediate said first and second ends, a protective inner space which allows insulated passage of a fluid from said rucksack, said fluid being conveyed from a receptacle adapted to be placed within said rucksack to said user through said protective inner space by an auxiliary pipe composed of a flexible tube and loop means provided on said at least one of said two straps intermediate said first and second ends for providing height adjustment of said tube.

2. The rucksack of claim 1, wherein the inner space is defined by a band which is folded on itself and thus maintained by means of rapid fastening means of a touch-and-close type.

3. The rucksack of claim 1, wherein the protective inner space is internally coated with at least one layer of isothermic material.

4. The rucksack of claim 1, wherein the rucksack has an eyelet on said exterior surface for passage of the flexible tube from the receptacle to the inner space.

5. The rucksack of claim 1, wherein the protective inner space is provided on the upper half of the strap.

6. The rucksack of claim 1, wherein the protective inner space is provided on the lower half of the strap.

7. The rucksack of claim 1, wherein said loop means comprises multiple loops, the flexible tube passing through one of them, enabling the height adjustment of fluid delivery of the fluid to the user at an end of the flexible tube.

8. The rucksack of claim 1, wherein the flexible tube runs continuously through the protective inner space.

9. The rucksack of claim 7, wherein said fluid is a liquid and said fluid delivery mean is a valve.

10. The rucksack of claim 7, wherein said fluid is a gas and said fluid delivery means is a gas mask.

11. The rucksack of claim 4, wherein the fluid is a liquid.

12. The rucksack of claim 4, wherein the fluid is a gas.

* * * * *